US010947649B2

(12) United States Patent
Castelli et al.

(10) Patent No.: US 10,947,649 B2
(45) Date of Patent: Mar. 16, 2021

(54) YARN FEEDER WITH MOTORIZED YARN-WINDING SPOOL AND REWINDING SYSTEM

(71) Applicant: L.G.L. ELECTRONICS S.p.A., Gandino (IT)

(72) Inventors: Rosario Castelli, Gandino (IT); Giovanni Pedrini, Leffe (IT)

(73) Assignee: L.G.L. ELECTRONICS S.P.A., Gandino (IT)

( * ) Notice: Subject to any disclaimer, the term of this patent is extended or adjusted under 35 U.S.C. 154(b) by 123 days.

(21) Appl. No.: 16/409,309

(22) Filed: May 10, 2019

(65) Prior Publication Data

US 2019/0368086 A1 Dec. 5, 2019

(30) Foreign Application Priority Data

May 30, 2018 (IT) ..... 102018000005840

(51) Int. Cl.
*D04B 15/48* (2006.01)
*B65H 51/22* (2006.01)
*D04B 27/10* (2006.01)

(52) U.S. Cl.
CPC ..... *D04B 15/482* (2013.01); *B65H 51/22* (2013.01); *D04B 27/10* (2013.01); *B65H 2701/31* (2013.01)

(58) Field of Classification Search
CPC ... D04B 15/482; B65H 51/22; B65H 2701/31
See application file for complete search history.

(56) References Cited

FOREIGN PATENT DOCUMENTS

| | | | |
|---|---|---|---|
| DE | 102004051520 | A1 | 5/2006 |
| EP | 3257984 | A | 12/2017 |
| WO | 03093550 | A1 | 11/2003 |

OTHER PUBLICATIONS

IT Search Report dated Feb. 13, 2019 re: Application No. 2018000005840, pp. 1-7.

*Primary Examiner* — William E Dondero
(74) *Attorney, Agent, or Firm* — Cantor Colburn LLP

(57) ABSTRACT

A yarn-winding assembly mounted on a support is provided with a motorized spool and with an oblique spacing pin, between which a yarn is wound. The spacing pin is supported so that it can rotate about an axis of the motorized spool by unidirectional rotary support elements. The spacing pin rotates freely with respect to the spool when the latter rotates in the yarn unwinding direction and the former is retained from rotating by stop elements, and is instead integral with the spool when the spool rotates in the opposite yarn rewinding direction.

10 Claims, 5 Drawing Sheets

YARN FEEDER WITH MOTORIZED YARN-WINDING SPOOL AND REWINDING SYSTEM

CROSS-REFERENCE TO RELATED APPLICATIONS

This application is related to and claims the benefit of Italian Patent Application No. 102018000005840, filed on May 30, 2018, the contents of which are herein incorporated by reference in their entirety.

TECHNICAL FIELD

The present disclosure relates to a yarn feeder with motorized yarn-winding spool, provided with a system for rewinding the previously fed yarn.

BACKGROUND

Yarn feeders of the so-called "positive" type are known in which the yarn that originates from a supply spool is wound repeatedly between a motorized spool and a spacing pin having a slightly oblique axis with respect to the axis of the spool. By making the spool rotate in the unwinding direction, the yarn is fed to a downstream textile machine, for example a knitting machine.

The spacing pin has the purpose of keeping the yarn turns wound on the spool mutually axially spaced.

The tension of the yarn is monitored continuously by a load cell connected to a control unit. The control unit, on the basis of the signal received from the load cell, modulates the speed of the spool so as to keep substantially constant on a desired level the tension of the yarn fed to the downstream machine, to the benefit of the quality of the knitting produced.

As is known, in knitting processes the feeder often has to recover a portion of the yarn previously fed to the downstream machine.

In these cases, a return device may be provided upstream of the feeder. During recovery, the yarn-winding spool is rotated to the opposite direction with respect to the feeding direction, and simultaneously the return device is activated in order to keep under tension the yarn upstream the spool.

A solution of this type is shown, for example, in EP 1501970 B1, in which the return device is based on a Venturi tube.

The introduction of a return device upstream of the spool entails a significant increase in cost, also because it has to be controlled so as to be activated synchronously with the spool.

In seeking a simpler and cheaper solution, EP3257984 by the same Applicant describes a yarn feeder with motorized yarn-winding spool, in which the spacing pin is supported rotatably about the axis of the spool by a bearing, so as to be biased to rotate in the two directions by the yarn. The rotation of the spacing pin is limited by stop means in the yarn unwinding direction and, optionally, also in the recovery direction.

The solution described above is very effective, allowing to keep the yarn under tension also in the recovery steps without having to install a dedicated return device upstream.

However, it has been found in practice that during the rewinding steps, especially in the initial moments, small slippages can occur between the yarn and the spacing pin, such as to compromise the operating precision and regularity of the device.

Therefore, the aim of the present disclosure is to improve the device described in EP 3257984 so as to increase its operating precision and regularity, while keeping the solution structurally simple and cheap to provide.

SUMMARY

This aim and these and other advantages which will become better apparent from the continuation of the description are achieved by providing a yarn feeder having the characteristics described in the independent claim, while the dependent claims define other advantageous, albeit secondary, characteristics of the disclosure.

BRIEF DESCRIPTION OF THE DRAWINGS

The disclosure will be now described in greater detail, with reference to some of its preferred but not exclusive embodiments, illustrated by way of non-limiting example in the accompanying drawings, wherein.

DETAILED DESCRIPTION OF THE DRAWINGS

Figure 1:
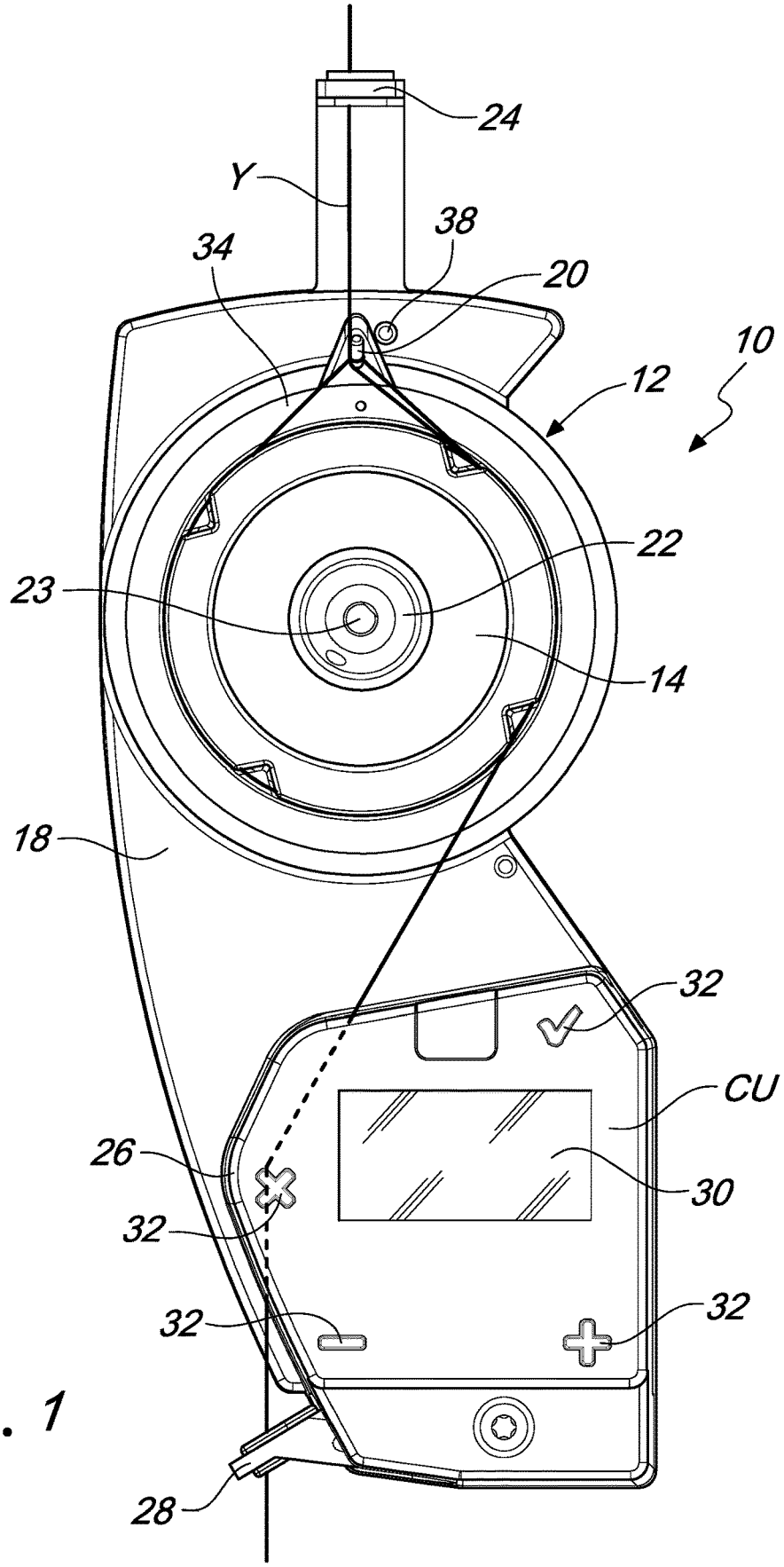
FIG. 1 is a front view of the yarn feeder according to the disclosure.
Figure 2:
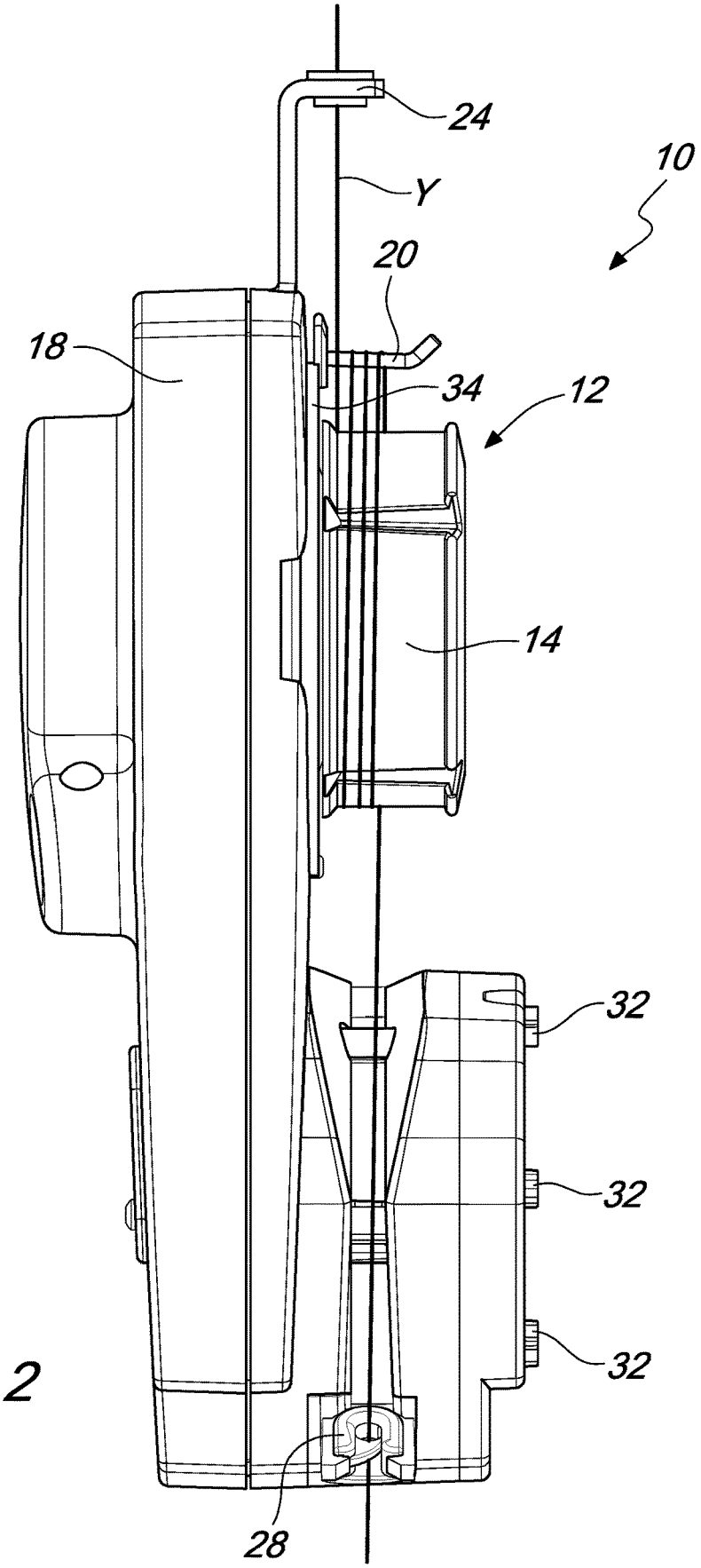
FIG. 2 is a lateral elevation view of the yarn feeder of FIG. 1.
Figure 3:
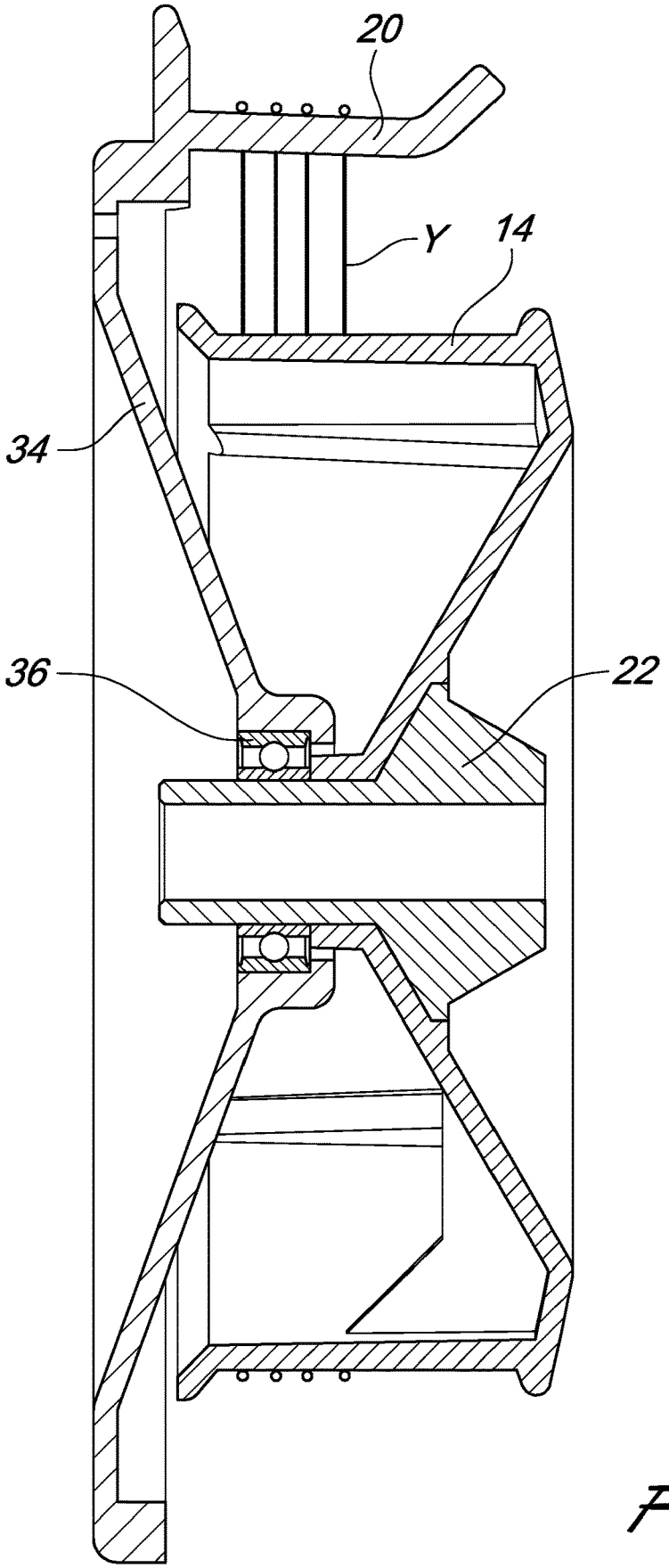
FIG. 3 is an axial sectional view of a part of the yarn feeder of FIG. 1.

With reference to FIGS. 1-5, a yarn feeder 10 comprises a yarn-winding assembly 12, which is provided with a spool 14 rotationally actuated by an electric motor (not shown) accommodated on a support 18, and with a spacing pin 20 that protrudes from the support 18 with an axis that is slightly inclined toward the axis of the spool. In a per se known manner, the spool 14 is mounted on a hub 22 (FIGS. 3 and 4) that is keyed on the shaft 23 of the electric motor.

The yarn Y that arrives from a supply spool (not shown), after passing through a yarn-guide inlet eyelet 24 integral with the support 18, is wound repeatedly (for example, four or five turns) between the spool 14 and the spacing pin 20. The spacing pin 20, in a per se conventional manner, has the purpose of keeping mutually axially spaced the turns of yarn wound on the yarn-winding assembly 12.

The yarn Y being unwound from the yarn-winding assembly 12 engages functionally a load cell 26 incorporated in the feeder and then is fed to the downstream machine by a yarn-guide outlet eyelet 28 which is integral with the support 18.

In a per se known manner, the motor 16 is driven by a control unit CU, also incorporated in the feeder, which can be programmed by means of a display 30 and buttons 32. The control unit CU modulates the speed of the spool 14 based on the signal received from the load cell 26, so as to keep the tension of the yarn Y substantially constant at a desired level; said tension depending on the difference between the speed with which the yarn is fed by the feeder and the speed with which it is collected by the downstream machine.

The programming of the control unit CU falls within the common knowledge of the person skilled in the art and therefore will not be discussed in depth herein.

The spacing pin 20 is integral with a flywheel 34 which, according to the disclosure, is supported rotatably about the axis of the spool 14 by a free wheel 36 also mounted on the hub 22 (FIG. 5); the free wheel 36 is adapted to allow the free rotation of the spacing pin 20 with respect to the spool 14 when the spool 14 rotates in the yarn feeding or "unwinding" direction of the yarn, and to block the rotation of the spacing pin 20 with respect to the spool 14 when said spool 14 rotates in the yarn recovery or "rewinding" direction; the rotation of the flywheel 34 being delimited in the unwinding direction by an abutment 38.

In the constructive example described herein, the abutment 38 is positioned so as to block the flywheel 34 in such a position that, by inserting the yarn between the spacing pin 20 and the spool 14 before winding it, the yarn passes through the yarn-guide inlet eyelet 24 in a substantially radial direction with respect to the axis of the spool.

According to an advantageous characteristic of the disclosure, the flywheel 34 is biased to rotate in the yarn unwinding direction, i.e, toward the abutment 38, not only by the friction with the yarn but also by elastic means functionally interposed between the flywheel 34 and the support 18.

Figure 4:
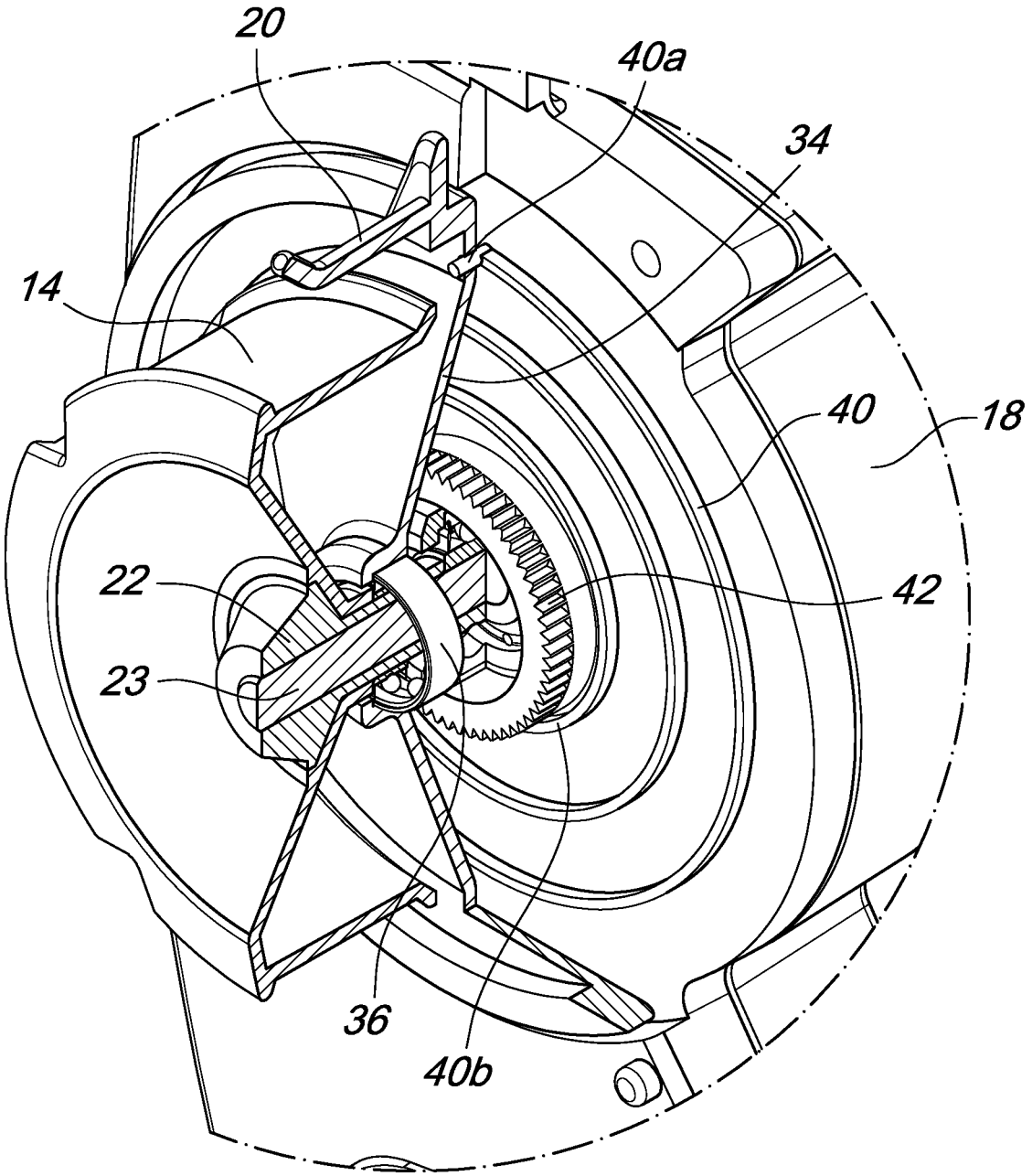
FIG. 4 is a partially sectional perspective view of a portion of the yarn feeder of FIG. 1.

In the embodiment described herein, with particular reference to FIG. 4, the elastic means comprise a spiral spring 40 arranged around the motor shaft. The spiral spring 40 has an end 40*a* fixed to the flywheel 34 and an opposite end 40*b* connected to the support 18, advantageously by virtue of preload adjustment means. Such means preferably include a toothed ring 42, the angular position of which can be adjusted manually with respect to the support 18.

The operation of the feeder according to the disclosure will be now described.

During feeding, the feeder 10 behaves in a traditional manner. The spool 14 rotates in the unwinding direction (clockwise in FIGS. 1, 3 and 5) and, as a result of the friction between the yarn Y and the spacing pin 20 and of the bias exerted by the spiral spring 40, the flywheel 34 is pushed into abutment against the abutment 38, as shown in FIG. 1. In this step, therefore, the spacing pin 20 acts as if it were rigidly coupled to the support 18.

Figure 5:
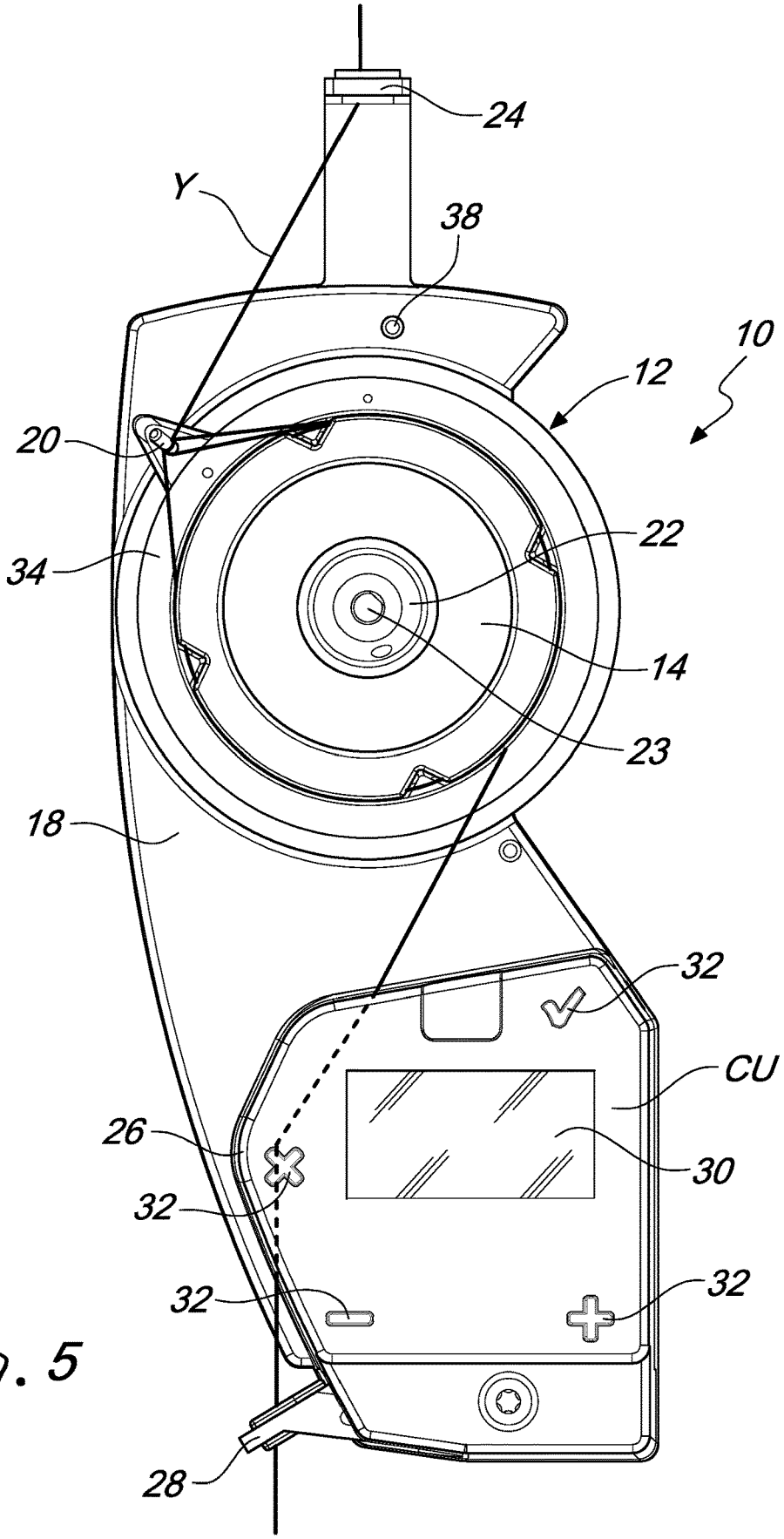
FIG. 5 is a view similar to FIG. 1, showing the yarn feeder according to the disclosure in a different operative configuration.

During rewinding, the spool 14 is rotated in the opposite direction (counterclockwise in FIGS. 1, 3, and 5) in order to draw back the yarn and keep it under tension (FIG. 5). In this direction, the free wheel 36 locks so as to rotate the flywheel 34 integrally with the spool 14, in contrast with the action of the spiral spring 40. Accordingly, the yarn is rewound between the spacing pin 20 and the spool 14, which rotate monolithically, so as to limit considerably the possibilities of slippage and increase the operating precision and regularity of the system.

In the following feeding cycle, as a result of the friction between the yarn Y and the spacing pin 20 and of the action of the spiral spring 40, the flywheel 34 will be again pushed in abutment against the abutment 38 and the feeder will resume to operate in a conventional manner (FIG. 1). In this step, the spiral spring 40 has the purpose of increasing the reactivity of the flywheel 34 in following the rotation of the spool 14 when it resumes to rotate in the unwinding direction of the yarn, after the rewinding cycle. By acting on the toothed ring 42 the preloading of the spiral spring 40 is adjusted with precision as a function of the variables involved (e.g., type of yarn, inertia of the spool 14 and of the flywheel 34, etcetera).

As the person skilled in the art will appreciate, the feeder 10 fully achieves the intended aim to increase the precision with which the yarn is kept under tension during the rewinding steps, without introducing constructive complications and increases in cost with respect to the solution described in EP 3257984.

A preferred embodiment of the disclosure has been described herein, but of course the person skilled in the art may be able to make various modifications and variations within the scope of the claims.

For example, in the example described herein the free wheel is of the ball bearing type, but it is also possible to use free wheels with roller bearings.

Nevertheless, the free wheel may be replaced by other unidirectional rotary support means, i.e, means capable of allowing free rotation in one rotational direction and transmit the rotatory motion in the opposite direction, such as ratchet mechanisms and the like.

Moreover, although in the described embodiment the spacing pin is mounted on a flywheel for an efficient balancing of the centrifugal loads, alternatively it might be mounted on other rotating supporting means, for example, a rotating arm optionally counterweighted on the opposite side.

Furthermore, the spacing pin might also be pivoted eccentrically, or about an inclined axis, with respect to the spool, e.g., in order to vary the tension curve during recovery.

Furthermore, as already specified, the stop position of the spacing pin might be varied according to the requirements.

Not least, the abutment might be replaced with different stop means, so long as they are capable of blocking the rotation of the pin in a desired point, including electrically actuated pins, as well as mechanical brakes, magnetic brakes or brakes of any other type.

What is claimed is:

1. A yarn feeder comprising: a yarn-winding assembly mounted on a support and provided with a motorized spool and an oblique spacing pin, between which a yarn is adapted to be wound, wherein said spacing pin is supported so that said spacing pin can rotate about an axis of said motorized spool by unidirectional rotary support means, which are adapted to allow the free rotation of the spacing pin with respect to the spool when the spool rotates in the yarn unwinding direction, the spacing pin being retained from rotating by stop means, and to block the rotation of the spacing pin with respect to the spool when the spool rotates in the opposite yarn rewinding direction.

2. The yarn feeder according to claim 1, wherein said unidirectional rotary support means comprise a free wheel.

3. The yarn feeder according to claim 1, further comprising elastic means interposed functionally between said spacing pin and said support and are adapted to bias said spacing pin to rotate in the yarn unwinding direction.

4. The yarn feeder according to claim 3, wherein said elastic means comprise a spiral spring having an end connected to said spacing pin- and an opposite end connected to the support.

5. The yarn feeder according to claim 3, further comprising means for adjusting a preload of said elastic means.

6. The yarn feeder according to claim 5, wherein said means for adjusting the preload comprise an annular element to which said opposite end of the spiral spring is connected, and the angular position of which with respect to the support can be adjusted manually.

7. The yarn feeder according to claim 1, wherein said stop means comprise an abutment.

8. The yarn feeder according to claim 1, wherein said spacing pin is supported so that said spacing pin can rotate about an axis that is substantially parallel to the axis of the spool.

9. The yarn feeder according to claim 8, wherein said spacing pin is supported so that said spacing pin can rotate about the axis of the spool.

10. The yarn feeder according to claim 1, further comprising a yarn-guide inlet eyelet upstream of said yarn winding assembly, and in that said stop means are arranged in such a way as to block said spacing pin in a position such that, by inserting the yarn between the spacing pin and the spool before winding the yarn, the yarn passes through said yarn-guide inlet eyelet—in a substantially radial direction with respect to the spool.

* * * * *